United States Patent [19]

Dubs et al.

[11] 4,410,098

[45] Oct. 18, 1983

[54] CHILDPROOF LOCKING CAP

[75] Inventors: Hans-Dieter Dubs, Worms; Gunter Spatz, Biblis; Carlos-Enrique Brandes, Worms, all of Fed. Rep. of Germany

[73] Assignee: Firma Alcoa Deutschland GmbH, Worms, Fed. Rep. of Germany

[21] Appl. No.: 391,387

[22] Filed: Jun. 23, 1982

[30] Foreign Application Priority Data

Jul. 3, 1981 [DE] Fed. Rep. of Germany ..... 8119446

[51] Int. Cl.[3] ..... B65D 55/02

[52] U.S. Cl. ..... 215/220; 215/251; 215/252; 215/258

[58] Field of Search ..... 215/219, 220, 251, 252, 215/258

[56] References Cited

U.S. PATENT DOCUMENTS 3,679,085 7/1972 Gach ..... 215/220

4,330,067 5/1982 Deussen ..... 215/220

*Primary Examiner*—George T. Hall

*Attorney, Agent, or Firm*—Staas & Halsey

[57] ABSTRACT

An assembly for a locking cap for containers with a threaded neck, having an inner cap, an intermediate cap, and an outer cap. The inner cap 1 has on its upper edge a circumferential knurl. The intermediate cap has on its inner face another knurl and on its top face. The outer cap has on its inner bottom face downwardly pointing projections 15. The knurl of the intermediate cap engages in the circumferential knurl of the inner cap. A container with this assembly can only be opened if pressure is applied to the top face of the outer cap.

10 Claims, 6 Drawing Figures

CHILDPROOF LOCKING CAP

BACKGROUND OF THE INVENTION

1. Field of the Invention

The invention relates to a kit on assembly for a locking cap for containers with a threaded neck which has an inner and an outer cap, in which the inner cap has on its upper edge an outwardly pointing knurl.

2. Description of the Prior Art

Cap seals are known consisting of a metal cap which has a female thread and which can be screwed onto appropriate containers. There are childproof cap seals consisting of two interlocking caps. The inner metal cap has on its upper edge an outwardly pointing knurl, while the outer cap has a knurl on its upper inner edge. When the outer cap is turned, it slides loosely over the inner metal cap seal and the closed container is not opened. However, if pressure is applied to the outer cap, the inner knurl of the outer cap engages in the knurl of the inner cap and the closed cap is opened.

Metal seal caps are likewise known having webs on their lower edge and connected to a ring by means of these webs. When such a cap seal is placed on the neck of a container, the webs, upon unscrewing the metal cap seal, are forced open and the ring remains on the neck of the container.

Such a cap seal, commonly known as pilferproof cap, makes it possible to exert control over the first-time opening of a container. When the cap seal is opened for the first time, the fact that the webs have been forced open indicates that the container has already been opened. Such a cap seal is used in liquor and soft-drink bottles as well as in medicine containers. A cap seal of the type cited in the introduction is exemplified by West German Disclosure Publication No. 29 43 548. The disadvantage of these known cap seals is that after repeated use it is no longer possible to close the containers in a reliable manner. The knurl located on the metal cap engages in the knurl of the outer cap so that even without exertion of pressure on the outer cap the cap seal can be opened. In addition, in these cap seals of known construction, there is no way to ascertain whether the seal has been closed with sufficient strength.

SUMMARY OF THE INVENTION

The primary object of this invention is to provide a childproof cap seal which, even after repeated use, cannot be opened by a child. In particular, it should be possible for an adult to check whether the container has been securely sealed.

In accordance with the teachings of this invention, this object is achieved by inserting between the inner and outer caps an intermediate cap having a knurl on its inner face and elevations or projections on its top face, by providing the inner bottom face of the outer cap with downwardly pointing elevations or projections, and by designing the knurl of the intermediate cap in such a way that it engages in the knurl of the inner cap.

The inner cap is placed on the threaded neck of a container, the thread is rolled on in a manner in itself known, and the lower edge is flanged. Then the intermediate cap is placed over the inner cap so that the knurl of the intermediate cap engages in the knurl of the inner cap. The outer cap is inverted over both caps, the elevations of the outer cap being placed above those of the intermediate cap.

As a result of its special design, the seal cap embodying the present invention makes it possible to close a container so that a child cannot open it. Then the closure is placed on a container, the outer cap, upon being turned, slides on the intermediate cap whose knurl engages in the knurl of the inner cap. The intermediate cap and the inner cap are not rotated when the outer cap is turned. However, if pressure is exerted upon the top face of the outer cap, the elevations or projections located on the bottom face of the outer cap engage in the elevations or projections located on the top face of the intermediate cap, and thus the intermediate cap is turned along with the inner cap when the outer cap is turned, and the container is opened.

It is impossible for a child to open the locking cap of this invention. If a child attempts to turn the cap, the outer cap merely slides along the intermediate cap and the inner cap. Furthermore, this closure will remain operational even after repeated use.

It is of particular advantage to design the cap as a "tamper proof" closure. In this form of construction the inner cap has a circumferential ridge and its lower edge is connected to a ring by means of webs. The lower edge of the outer cap is bent inwardly and engages under the ridge of the inner cap. Because of its special design, this closure makes it possible to exert control over accidental openings of the container. The ring, which is connected to the lower edge of the inner cap by means of webs, remains on the neck of the container when the closure is opened by forcing open, i.e. severing, the webs. However, the closure can only be opened if pressure is applied to the top face of the outer cap and the closure is turned simultaneously. Because of the double safety feature of this closure, it is highly unlikely that the container can be opened by a child. Similarly, it is possible to exercise control over the first-time opening of a container. In the case of many fluids, in particular medications, it is desirable that such multiple securing operations of the closure be performed in a simple manner. The ring remaining on the neck of the container indicates that the closure has already been opened.

According to other embodiments of the invention, the top face of the outer cap, or the top face of the intermediate cap, is made convex in shape. In these forms of construction, one of the caps is elastic in axial direction so that this cap flexes when pressure is exerted upon its top surface, causing the elevations to interlock. After release of the pressure, the elevations no longer interlock because of the space between them, so that the closure can function reliably even after repeated use.

According to the preferred embodiment of the invention, the elevations or projections of the outer cap and of the intermediate cap are arranged in a ring-shaped area. Preferably, the projections of the outer cap are designed as triangles and those of the intermediate cap as radial teeth. According to this preferred embodiment, the teeth on the intermediate cap only engage between the triangles of the outer cap when pressure is being applied to the top face of the outer cap. Thus, it is ensured that even after repeated use the outer cap can only be turned together with the inner cap when pressure is being applied to the top face of the outer cap.

Preferably, the inner cap consists of aluminum and the outer cap and the intermediate cap are of plastic. The outer cap and the intermediate cap are, for example, made by injection molding, during which the desired teeth, triangles, elevations or projections can simply be placed on the outer cap and the intermediate cap, and at the same time on the other face the desired structure. Due to the fact that the inner cap is made of aluminum, a simple arrangment of the thread is possible.

Preferably, the outer cap has a shoulder on its inner surface. This shoulder is preferably designed as a circumferential ring. According to this special form of construction, accidental removal of the outer cap from the intermediate cap is no longer possible. The intermediate cap rests on the circumferential shoulder, thus preventing accidental removal of the outer cap from the two other caps.

According to another embodiment, the elevations on the intermediate cap have a trapezoidal cross section, in which one side is inclined and the opposite side is at right angles or slightly angularly disposed to the face of the intermediate cap.

According to another embodiment, the elevations of the outer cap have two lateral faces, one lateral face being inclined and the other side at right angles or slightly angularly disposed toward the bottom face of the outer cap.

According to these two embodiments, when the container is closed by turning, its vertical lateral faces make contact with one another and ensure proper closing of the container. When the container is opened, its inclined lateral faces slide onto each other so that the container cannot be opened. If pressure is applied to the top face of the outside cap, the inclined lateral faces can no longer slip away from each other and thus ensure the desired opening of the container. In these embodiments of the inventon, it is further possible to ascertain by a click whether the closure is securely closed. Since the inclined lateral faces of the elevations slide onto each other when the outer cap is turned in the direction of opening—during which the inner cap is not opened—a slight click is produced. When the closure is closed firmly by turning, an adult can ascertain by this click that it is properly closed. However, if the closure is closed by turning it only slightly, then the force used for the turning is sufficient to reopen the container.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT(S)

Figure 1:
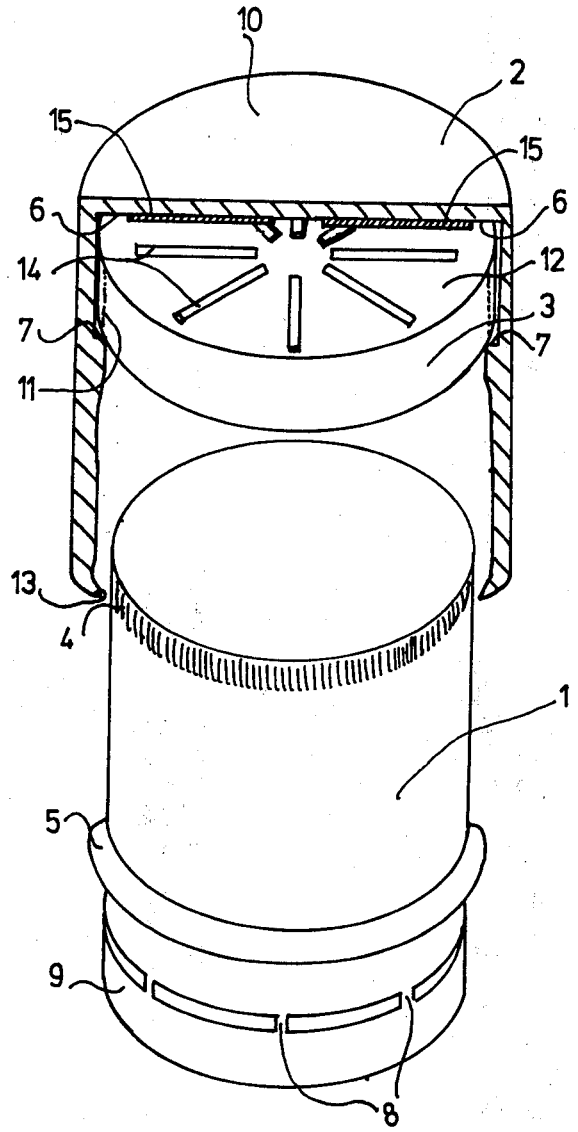
FIG. 1 is a perspective view of a locking cap in accordance with the teachings of the present invention, in which half of the outer cap is shown in cross section.

As shown in FIG. 1, the locking-cap kit or assembly embodying the principles of the present invention comprises an inner cap 1, an intermediate cap 3 and an outer cap 2. For the purpose of clarity, in FIG. 1 the outer cap and the intermediate cap are removed from the inner cap. The inner cap 1 has on its upper edge an outwardly pointing circumferential knurl 4. In the lower region cap 1 has a circumferential ridge 5 and its lower edge is connected to the ring 9 by webs 8.

The intermediate cap 3 has on its inner face a knurl 11. Elevations or projections 14 are located on the top face 12 of the intermediate cap 3. On its bottom face 6 the outer cap 2 has downwardly pointing elevations or projections 15, and its lower edge 13 is bent inwardly. If the outer cap 2 is above the inner cap 1, the bent lower edge 13 of the outer cap 2 engages under the ridge 5 of the inner cap 1. The intermediate cap 3 rests on the shoulder 7 of the outer cap so that the intermediate cap 3 cannot slide downwardly accidentally. The elevations 15 of the outer cap 2 the get between the elevations 14 of the intermediate cap 3 if pressure is applied to the top face 10 of the outer cap 2.

The elevations (projections) 14 and 15 are located in a ring-shaped area. The elevations 14 of the intermediate cap 3 are designed as radial teeth. When the outer cap 2 is turned, it slides along the intermediate cap 3 and even when the intermediate cap 3 is on the inner cap 1, the container cannot be opened. If pressure is applied to the surface 10 of the outer cap 2, the outer cap slides downwards and the elevations 15 get between the elevations 14 of the intermediate cap. Then, if the outer cap 2 is turned further while pressure is still being applied to the top face 10 thereof, the intermediate cap 3 is carried along and, because of the knurls 11 and 14, also the inner cap 1, and the closure can be removed from the container.

When the outer cap 2 is turned for the first time, during which pressure is simultaneously applied to the top face 10 as described above, the webs 8 of the inner cap 1 are broken and the ring 9 remains on the container, while the outer cap 2 can be removed together with the intermediate cap 3 and the inner cap 1. The inner cap 1 cannot separate from the outer cap 2 because the bent lower edge 13 of the outer cap 2 engages under the ridge 5 of the inner cap.

Figure 2:
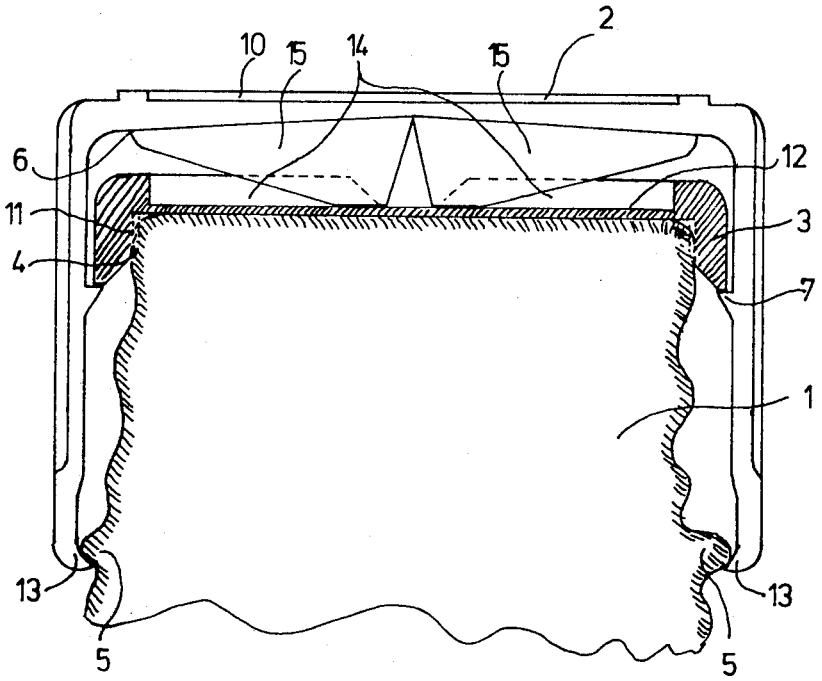
FIG. 2 is a section through the outer cap, the intermediate cap, and the inner cap.
Figure 3:
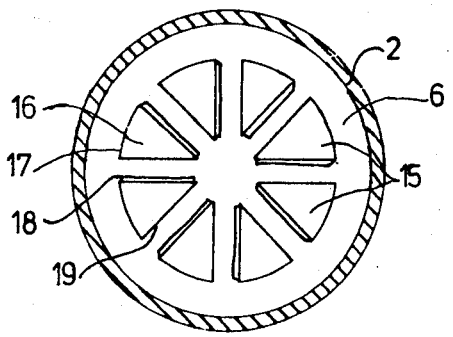
FIG. 3 is an inside view of the bottom face of the outer cap.

FIG. 2 again shows the arrangement of the outer cap 2 above the intermediate cap 3 and the inner cap 1. In FIG. 2 all three caps are placed on top of each other, and the thread in the inner cap 1 is also shown. The lower edge 13 of the outer cap 2 engages under the ridge 5 of the inner cap. The knurl 11 on the inner face of the intermediate cap 3 engages the knurl 4 on the upper circumferential edge of the inner cap 1 so that the intermediate cap 3 rests firmly on the inner cap 1. The shoulder 7 of the outer cap 2 also engages under the lower edge of the intermediate cap 3 so that the outer cap 2 cannot easily be removed from the intermediate cap and the inner cap. The elevations (projections) 14 are located on the top face 12 of the intermediate cap 3. In FIG. 3, the elevations (projections) 15 of the outer cap 2 are located between the elevations 14. The elevations 15 are located on the inner bottom face 6 of the outer cap 2. If pressure is applied to the top face 10 of the outer cap 2, the elevations 15 carry along the intermediate cap and the inner cap when the outer cap 2 is turned, because of the elevations 14, and the locking cap can be opened.

FIG. 3 is an inside view of the bottom face 6 of the outer cap 2. The elevations (projections) 15 are triangular 16 in shape, with curved bases 17. The bases 17 may also be straight. The elevations (projections) 15 have two lateral faces 18 and 19, the lateral face 18 being inclined and the other lateral face 19 being at right angles to the bottom face of the outer cap. This arrangement of the lateral faces will be elaborated upon in the following section when describing FIGS. 5 and 6.

Figure 4:
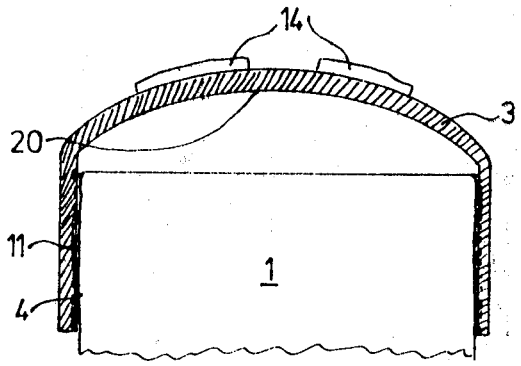
FIG. 4 is a section through the intermediate cap and a part of the inner cap.

As shown in FIG. 4, the intermediate cap 3 lies above the inner cap 1. The knurl 11 of the intermediate cap 3 engages the knurl 4 of the inner cap 1. The intermediate cap 3 has the curved top face 20, on which the elevations (projections) 14 are shown.

Figure 5:
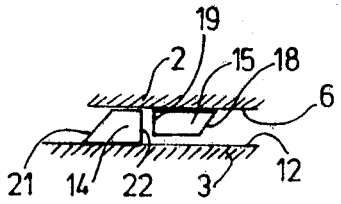
FIG. 5 is a section through the elevations of the outer cap and of the intermediate cap.

As apparent from FIGS. 4 and 5, the outer cap 2 has the elevations (projections) 15 on its bottom face 6. These elevations are illustrated in section so as to show the inclined lateral faces 18 and 19. In addition, the intermediate cap 3 has on its top face 12 the elevations (projections) 14, which have trapezoidal cross sections. Side 21 of the elevation 14 is inclined and the opposite side 22 is normal to the top face 12. If the closure is to be closed, turning the outer cap 2 to close it corresponds to moving the outer cap 2 to the left (FIG. 5). Therefore, it will be noted that turning the closure to close it will cause the vertical lateral face 10 of the elevation 15 to make contact with the vertical lateral face 22 of the elevation 14, causing the intermediate cap 3 and the inner cap 1 to be closed.

Figure 6:
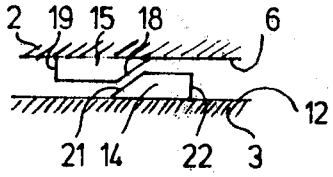
FIG. 6 is a section through the elevations of the outer cap and of the intermediate cap.

In contrast to the above, the opening of the container will be described with reference to FIG. 6. Opening the closure, that is to say, unscrewing the outer cap 2, corresponds to moving the outer cap 2 to the right (FIG. 6). It will be noted that during this rotational movement the inclined lateral face 18 of the elevation 15 makes contact with the equally inclined lateral face 21 of the elevation 14. Owing to the force exerted on the outer cap 2, the latter is pushed upwards and the elevation 15 slides past the elevation 14. The inclined lateral faces, which impinge upon each other, slide past one another. Turning the cap further to the right, which corresponds to moving the outer cap 2 in the manner shown in FIG. 6, will result in a click when the elevation 15 gets to the right of the elevation 14. The adjacent elevation 14 again causes the inclined lateral face 18 to slide upwards along its lateral face 21 not shown herein. However, if pressure is applied to the outer cap 2 so that the inclined lateral face 18 of the elevation 15 cannot slide upwards along the inclined lateral face 21, then, when the outer cap 2 is unscrewed, which corresponds to moving the elevation 15 in FIG. 6 to the right, the elevation 14 of the intermediate cap 3 is carried along, and the closure can be opened.

It will be noted from this description that the child-proof closure can be opened only if pressure is applied to the top face of the outer cap. If the outer cap is turned in the direction of opening when the container is closed tightly without applying pressure to the top face of the outer cap, a click is heard indicating that the elevations 15 slide out of the elevations 14. If the closure is not closed sufficiently tightly, it can be opened by a simple turn, and no click is heard. In this way control can be exercised over the tight closing of the locking cap.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A locking cap for containers with a threaded neck comprising an inner and an outer cap, the inner cap carrying on its upper edge a circumferential knurl, wherein between the inner and the outer cap an intermediate cap having on its inner surface another knurl and on its top face upward projections, the outer cap having on its inner bottom face downwardly pointing projections, and the knurl of the intermediate cap being designed to engage in the circumferential knurl of the inner cap.

2. A locking cap according to claim 1, wherein the top face of the outer cap is made convex.

3. A locking cap according to claim 1, wherein the top face of the intermediate cap is made convex.

4. A locking cap according to claims 1, 2 or 3, wherein the projections of the outer cap and of the intermediate cap are arranged in a ring-shaped area.

5. A locking cap according to claim 4, wherein the projections of the outer cap are formed as triangles and the projections of the intermediate cap are formed as radial teeth.

6. A locking cap according to claim 5, wherein the inner cap consists of aluminum, the outer cap and the intermediate cap consists of plastic.

7. A locking cap according to claims 1, 2 or 3 wherein the outer cap has a shoulder on its inner face.

8. A locking cap according to claim 7, wherein said shoulder is designed as a circumferential ring.

9. A locking cap according to claim 4, wherein the projections of the intermediate cap have a trapezoidal cross section, one side being inclined and the opposite side at substantially right angles to the top face of the intermediate cap.

10. A locking cap according to claim 4, characterized in that the projections of the outer cap have two lateral faces, one lateral face being inclined and the other lateral face at substantially angles to the bottom face of the outer cap.

* * * * *